United States Patent [19]

Yamaguchi et al.

[11] 4,308,898

[45] Jan. 5, 1982

[54] SLIDE FASTENER TAPE

[75] Inventors: Yoshiharu Yamaguchi, Namerikawa; Mitsuo Horikawa, Kurobe, both of Japan

[73] Assignee: Yoshida Kogyo K.K., Tokyo, Japan

[21] Appl. No.: 132,290

[22] Filed: Mar. 20, 1980

[30] Foreign Application Priority Data

Mar. 4, 1979 [JP] Japan ..... 54/44366[U]

[51] Int. Cl.[3] ..... D03D 3/00

[52] U.S. Cl. ..... 139/384 B; 24/205.16 R

[58] Field of Search ..... 139/384 B; 24/205.16 R, 24/205.16 C

[56] References Cited

U.S. PATENT DOCUMENTS

| | | | |
|---|---|---|---|
| 1,837,011 | 12/1931 | Blair | 24/205.16 R |
| 1,949,889 | 3/1934 | Sundback | 139/384 B |
| 2,061,073 | 11/1936 | Hendley | 139/384 B |
| 2,373,835 | 4/1945 | Jones | 139/384 B |
| 3,179,996 | 4/1965 | Clauss | 24/205.16 R |
| 3,454,052 | 7/1969 | Burbank | 139/384 B |
| 4,123,830 | 11/1978 | Matsuda et al. | 24/205.16 R |

FOREIGN PATENT DOCUMENTS

| | | | |
|---|---|---|---|
| 758533 | 10/1956 | United Kingdom | 139/384 B |

*Primary Examiner*—Henry Jaudon

*Attorney, Agent, or Firm*—Hill, Van Santen, Steadman, Chiara & Simpson

[57] ABSTRACT

Disclosed herein is an improvement in a slide fastener tape including a tape body comprising interlaced warp ends and weft picks and a beaded edge having a core member disposed parallel to the tape body at one side thereof and a plurality of appendant warp ends which form a circular weave with the weft picks of the tape body enclosing the core member. According to this invention, the appendant warp ends are placed only on the upper and lower sides of the core member so as to make the cross section of the finished beaded edge generally rectangular with a height greater than the width.

4 Claims, 13 Drawing Figures

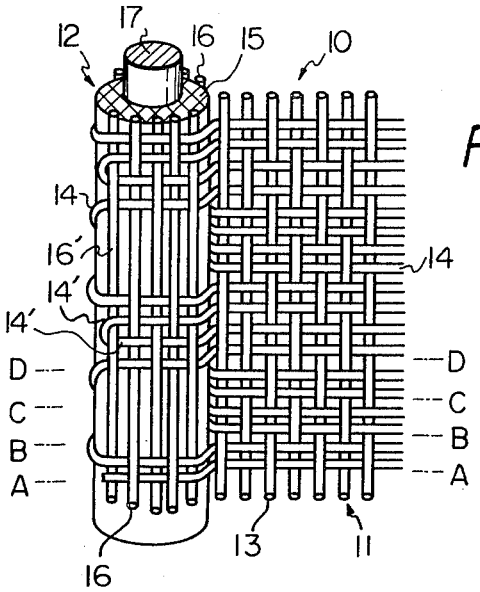
Fig. 1
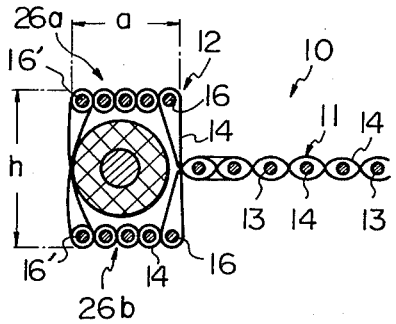
Fig. 2
Fig. 3
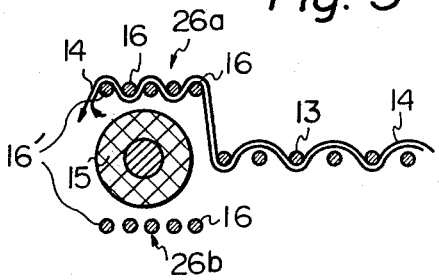
Fig. 4
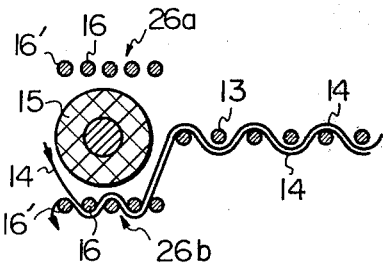

SLIDE FASTENER TAPE

BACKGROUND OF THE INVENTION

This invention relates to a woven tape used for slide fasteners. Particularly, the invention relates to a woven tape having an improved beaded edge to which fastener elements may be firmly and reliably fixed.

Heretofore, a fastener tape has been well known in which a core member is disposed in parallel to one side edge of the tape and warp ends are provided around the outer periphery of the core member, a circular weave being made between the warp ends and the weft picks of the tape body to form a beaded edge comprising the core member and the encircling warp ends. Fastener elements made of metal or injection molded plastics are fixed to the tape by clamping the beaded edge by their upper and lower legs. Since a cord is used as a core member, the cross section of the core member is generally circular. Furthermore, the warp ends are evenly disposed around the core member. Therefore, the resulting beaded edge also has a circular cross section. The tape is first formed in a long continuous woven web and the fastener elements are fixed to the tape by clamping the beaded edge of the tape by their legs. Before the fastener elements are fixed to the tape, the tape is subjected to various processes such as a dyeing process. During these processes, the tape is taken up on a drum or roller and by this taking up operation, the beaded edge constructed as above is pressed into a flat shape. Since the beaded edge has originally a circular cross section, the flattened beaded edge presents generally elliptical configuration. The elliptical shape is disadvantageous because a sharp edge or distinct step is not formed between the beaded portion and the body of the tape. Furthermore, in case of a flat beaded edge it is very likely that the laterally expanded inner side portion of the beaded edge is not received in the space defined by the two legs of an element and the inwardly bent end portions of the legs. If this occurs, securement of the element becomes unreliable and the inwardly bent end portions of the legs damage the weft picks of the beaded edge.

Fastener tapes having the beaded edges of the abovementioned kind are disclosed in U.S. Pat. Nos. 1,949,889 and 2,061,073 issued on Mar. 6, 1934 and Nov. 17, 1936, respectively and U.K. Pat. No. 758,533 published on Oct. 3, 1956. However, none of them teaches an approach for eliminating the above described shortcomings.

SUMMARY OF THE INVENTION

The object of this invention is to eliminate the abovementioned disadvantage of the previous beaded edges of fastener tapes by providing a woven tape in which a beaded edge is hard to be flattened and retains a generally rectangular cross section during processes from a weaving step to a fastener element fixing step.

According to this invention, a fastener tape has a beaded edge which comprises a core member disposed along one of the longitudinal edges of a tape body, a plurality of warp ends appendant to the core member and disposed on each of the upper and lower sides of the core member and weft picks constituting the tape body. The appendant warp ends are interlaced with the weft picks of the body of the tape so as to form a circular weave therebetween enclosing the core member. The resulting beaded edge has a generally rectangular cross section having a height greater than the width. Although the beaded edge is compressed and the height thereof somewhat decreases when taken up in a drum or a roller during the processes from a weaving step and an element fixing step, its cross section retains a generally rectangular shape since the appendant warp ends are placed only on the upper and lower sides of the core member.

Due to this cross sectional configuration, a distinct step is obtained between the beaded edge and the tape body. Therefore, the beaded edge of the tape is hard to deform into a flat configuration and is neatly received in the space between the upper and lower legs of the element. Therefore, it is possible to secure fastener elements to the beaded edge firmly and reliably, and thus, there is substantially no chance that the inwardly bent end portions of the legs of the elements will damage the inner side margin of the beaded edge.

BRIEF DESCRIPTION OF THE DRAWINGS

The invention will be described in more detail with reference to the accompanying drawings which illustrate embodiments of the invention, in which:

FIG. 1 is a perspective view of a portion of a fastener tape made according to this invention showing the texture thereof;

FIG. 2 is an end view of the tape shown in FIG. 1;

FIG. 3 is a cross sectional view taken along the line A—A in FIG. 1;

FIG. 4 is a cross sectional view taken along the line B—B in FIG. 1;

DESCRIPTION OF THE PREFERRED EMBODIMENTS

Figure 5:
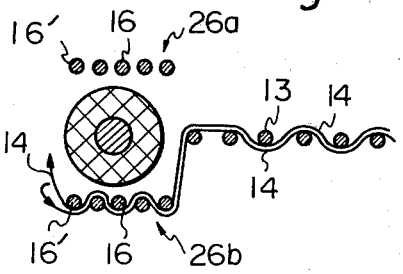
FIG. 5 is a cross sectional view taken along the line C—C in FIG. 1.
Figure 6:
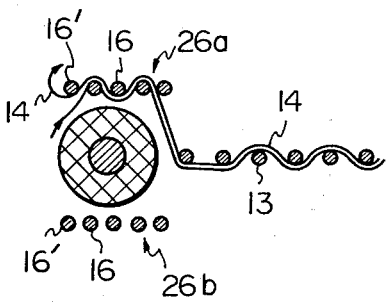
FIG. 6 is a cross sectional view taken along the line D—D in FIG. 1.

Referring to FIGS. 1 and 2, there is shown a fastener tape generally designated by numeral 10. A core member 15 is provided along one side or longitudinal edge of a tape body 11 consisting of interlaced warp ends 13 and weft picks 14. The core member 15 is of generally circular cross section having a diameter greater than the thickness of the tape body 11. A group **26*a* (or 26*b*) consisting of a plurality of appendant warp ends 16 is provided on each of the upper and lower sides of the core member 15. In each group, the appendant warp ends 16 are disposed in side-by-side relationship with each other. The appendant warp ends 16 of the upper and lower appendant warp groups 26*a* and 26*b* are interlaced with the weft picks 14 constituting the tape body 11 so that each weft pick 14 goes under one of every two appendant warp ends thereby forming a circular weave between the appendant warp ends 16 and the weft picks 14 to form at one side of the tape body 11 a beaded edge 12. Since the beaded edge 12 comprises the core member 15 and the appendant warp ends 16** placed only at the upper and lower sides of the core member, it has a generally rectangular cross section in which the height "h" is greater than the width "a".

Every four weft picks 14 is alternatively interlaced with the appendant warp groups 26a and 26b on the upper and lower sides of the core member 15. In every four weft picks 14 thus interlaced alternatively with the appendant warp ends 16 of the upper and lower appendant warp groups 26a and 26b, the inner two weft picks 14' are threaded so that they draw a line which passes around and returns from the outermost appendant warp end 16' in each of the upper and lower appendant warp groups 26a and 26b. This weaving manner is preferable in this invention in the sense that the appendant warp ends 16 in the warp groups 26a and 26b placed at the upper and lower sides of the core member 15, respectively, are positively retained in their places by the weft pickes 14' and are prevented from shifting.

The core member 15 is in the form of a knitted cord having a twisted yarn 17 in the center thereof. The core member 15 of a knitted cord has a dense and tight texture compared with a core member made of a twisted cord, and thus, is hard to deform. Therefore, when the core member 15 is constricted by the weft picks 14 encircling the core member as the weft picks 14 are interlaced with the appendant warp ends 16, the core member 15 is not so deformed that a segment between adjacent two weft picks 14 encircling the core member 15 presents a barrel like shape. Therefore, it is advantageous in this invention to use a knitted cord as the core member 15.

FIGS. 3 to 6 are cross sectional views of the embodiment shown in FIG. 1 taken through lines A—A, B—B, C—C and D—D respectively, to show how the weft picks 14 are interlaced with the warp ends 16 of the upper and lower warp groups 26a and 26b in respective places.

Figure 7:
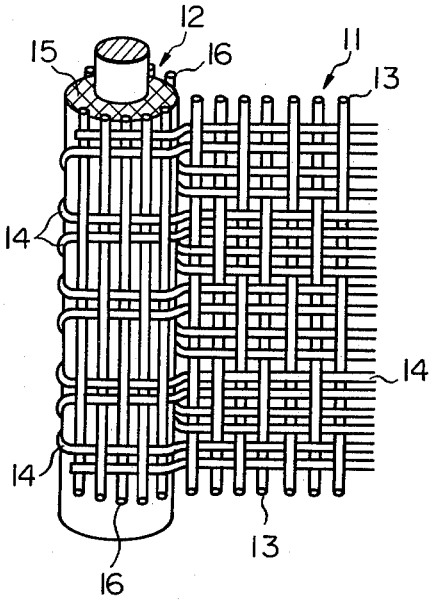
FIG. 7 is a perspective view of another embodiment according to this invention.
Figure 8:
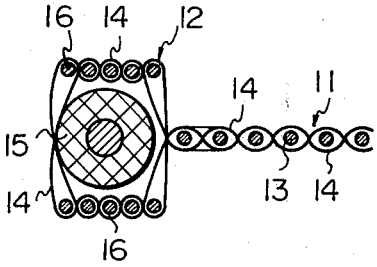
FIG. 8 is an end view of the tape shown in FIG. 7.

FIGS. 7 and 8 show another embodiment which is similar to the embodiment shown in FIG. 1 except that every two weft picks 14 alternatively appears at the upper appendant warp group 26a and the lower appendant warp group 26b.

Figure 9:
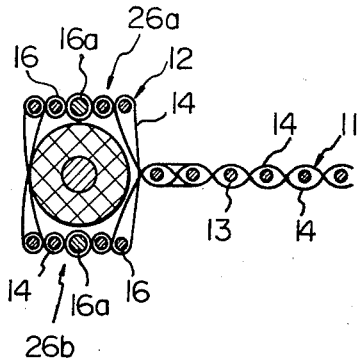
FIGS. 9 to 12 are end views showing other embodiments of this invention.

FIG. 9 shows another embodiment in which the appendant warp end 16a at the center in each of the upper and lower appendant warp groups 26a and 26b is made thicker than the other warp ends 16. Except for this point, the arrangement of this embodiment is the same as that of the embodiment of FIGS. 1 and 2. According to this embodiment, the beaded edge can be made higher.

Figure 10:
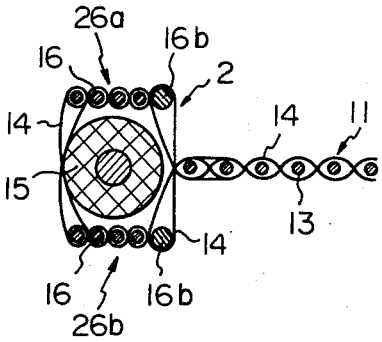

FIG. 10 shows another embodiment in which the appendant warp end 16b closer to the tape body 11 in each of the upper and lower warp groups 26a and 26b is thicker than the other appendant warp ends 16. This embodiment is preferred because the inner side of the cross section of the finished beaded edge approaches closer to an exact rectangular configuration. Except for this point, the arrangement of this embodiment is the same as that of the embodiment of FIGS. 1 and 2.

Figure 11:
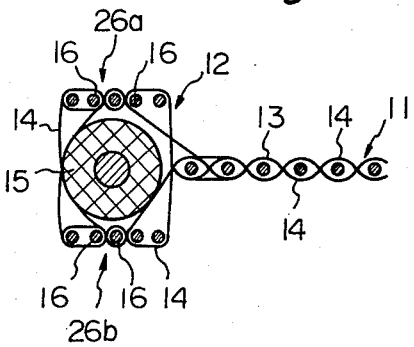

FIG. 11 shows another embodiment in which the appendant warp ends 16 are interlaced with the weft picks 14 by weaving in another way. Particularly, of the five appendant warp ends 16 placed in side-by-side relation in each of the warp groups 26a and 26b, each two warp ends at the right and left sides are treated as one integral warp end during a circular weave process. Except for this point, the arrangement of this embodiment is the same as that of the embodiment of FIGS. 1 and 2.

Figure 12:
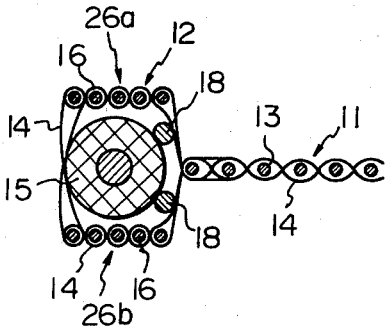

FIG. 12 shows another embodiment in which sub-core members 18 of narrower cross section than the core member 15 are disposed at the inner side of the core member adjacent the tape body 11 and vertically spaced so that they are placed on the opposite sides of the plane of the tape body. The places of the sub-core members are selected so as to make the cross section of the inner side of the finished beaded edge closer to an exact rectangular configuration. Except for this point, the arrangement of this embodiment is the same as that of the embodiment of FIGS. 1 and 2. However, the same weaving way as used for the embodiments of FIGS. 7 and 11 can be used.

It has been experimentally confirmed that although a beaded edge according to this invention is also compressed when taken up on a drum or roller, it retains, whichever one of the embodiments described above is used, a generally rectangular cross section.

Figure 13:
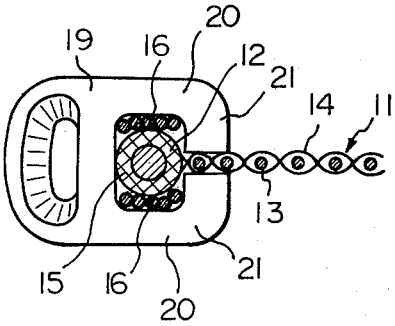
FIG. 13 is a cross sectional view of a tape made according to this invention to which a fastener element is fixed.

FIG. 13 shows the tape of FIG. 1 on which a fastener element 19 is fixed. As is appreciated from this drawing, the beaded edge 12 retains a generally rectangular shape and it is fully received in the space defined by the legs 20 of the element and the inwardly bent end portions 21 of the legs without the inner margin of the beaded edge being flattened and laterally expanding out of the space, while the beaded edge has a enough height so that is strongly bears against the inner surfaces of the legs of the element. Because of strong engagement between the upper and lower sides of the beaded edge and the inner surfaces of the legs of the element, and of a distinct step at the inner margin of the beaded edge due to its rectangular shape, the fastener element can be firmly and reliably fixed to the beaded edge. Furthermore, the tips of the inwardly bent end portions of the element legs do not damage the weft picks at the inner side margin of the beaded edge.

What is claimed is:

1. A slide fastener tape to which fastener elements are to be secured to the tape along one of the longitudinal edges thereof by clamping the edge with the upper and lower legs of each of the fastener elements, the slide fastener tape comprising a tape body formed by interlaced warp ends and weft picks, a core member disposed along said one longitudinal edge of said tape body, and upper and lower groups of appendant warp ends, each group consisting of a plurality of appendant warp ends disposed on only the respective upper and lower sides of said core member, said weft picks of the tape body being interlaced with said plurality of appendant warp ends disposed on the upper and lower sides of the core member to form a circular weave, thereby forming a beaded edge to which the fastener elements are to be secured having a cross section generally rectangular with a height greater than the width.

2. A slide fastener tape according to claim 1 further characterized in that said core member is made of a knitted cord.

3. A slide fastener tape according to claim 1 or 2 further characterized in that the appendant warp end closer to the tape body in each of said upper and lower warp groups is thicker than the other appendant war ends.

4. A slide fastener tape according to claim 1 or 2 further characterized in that sub-core members of narrower cross section than the core member are disposed at the inner side of the core member adjacent the tape body and vertically spaced so that they are placed on the opposite sides of the plane of the tape body.

* * * * *

UNITED STATES PATENT AND TRADEMARK OFFICE

CERTIFICATE OF CORRECTION

PATENT NO. : 4,308,898

DATED : January 5, 1982

INVENTOR(S) : Yoshiharu Yamaguchi and Mitsuo Horikawa

It is certified that error appears in the above—identified patent and that said Letters Patent is hereby corrected as shown below:

On the title page, Item /30/ Foreign Application Priority Data

Delete "Mar. 4, 1979 [JP] Japan .....54-44366[U]"

and insert therefor:

--April 3, 1979 [JP] Japan .....54-44366[U]

Signed and Sealed this

Twenty-second Day of March 1983

[SEAL]

Attest:

GERALD J. MOSSINGHOFF

Attesting Officer

Commissioner of Patents and Trademarks